US009481177B2

(12) United States Patent
Takano et al.

(10) Patent No.: US 9,481,177 B2
(45) Date of Patent: Nov. 1, 2016

(54) WASTE INK ABSORBER, WASTE INK TANK, AND LIQUID DROPLET EJECTING DEVICE

(71) Applicant: SEIKO EPSON CORPORATION, Tokyo (JP)

(72) Inventors: Hidehiro Takano, Nagano (JP); Shunichi Seki, Nagano (JP); Yoshiyuki Nagai, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/140,199

(22) Filed: Dec. 24, 2013

(65) Prior Publication Data

US 2014/0184692 A1 Jul. 3, 2014

(30) Foreign Application Priority Data

Dec. 27, 2012 (JP) ..... 2012-284514
Dec. 27, 2012 (JP) ..... 2012-284516

(51) Int. Cl.
*B41J 2/165* (2006.01)

(52) U.S. Cl.
CPC ..... *B41J 2/16508* (2013.01)

(58) Field of Classification Search
CPC ..... B41J 2/16523; B41J 2002/1742; B41J 2/1721; B41J 2/165; B41J 2/16508; B41J 2002/1856
USPC ..... 347/31, 36, 90, 29
See application file for complete search history.

(56) References Cited

U.S. PATENT DOCUMENTS

| | | | | |
|---|---|---|---|---|
| 8,322,820 | B2 | 12/2012 | Hizawa | |
| 2004/0090503 | A1* | 5/2004 | Kotaki et al. | 347/86 |
| 2008/0136865 | A1* | 6/2008 | Sakurai | 347/30 |
| 2011/0080445 | A1* | 4/2011 | Shimizu et al. | 347/31 |
| 2012/0069086 | A1 | 3/2012 | Tanaka | |

FOREIGN PATENT DOCUMENTS

| | | | |
|---|---|---|---|
| JP | 03-182363 | A | 8/1991 |
| JP | 08-112914 | A | 5/1996 |
| JP | 08-311755 | A | 11/1996 |
| JP | 11081124 | A * | 3/1999 |
| JP | 2008-279646 | A | 11/2008 |
| JP | 2011-079192 | A | 4/2011 |
| JP | 2011-167960 | A | 9/2011 |
| JP | 2012-086551 | A | 5/2012 |

* cited by examiner

*Primary Examiner* — Jannelle M Lebron
(74) *Attorney, Agent, or Firm* — Global IP Counselors, LLP

(57) ABSTRACT

To provide a waste ink absorber having excellent permeability and retention, a waste ink absorber absorbing waste ink discharged from a head for injecting ink is provided with a first portion and a second portion having different densities, and the first portion has higher density than the second portion.

12 Claims, 8 Drawing Sheets

WASTE INK ABSORBER, WASTE INK TANK, AND LIQUID DROPLET EJECTING DEVICE

CROSS-REFERENCE TO RELATED APPLICATIONS

This application claims priority to Japanese Patent Application No. 2012-284514 filed on Dec. 27, 2012 and Japanese Patent Application No. 2012-284516 filed on Dec. 27, 2012. The entire disclosure of Japanese Patent Application Nos. 2012-284514 and 2012-284516 is hereby incorporated herein by reference.

BACKGROUND

1. Technical Field

The present invention relates to a waste ink absorber, a waste ink tank, and a liquid droplet ejecting device.

2. Background Technology

A liquid ejecting device is known in which a waste liquid receptacle into which liquid discharged from an injection head flows and a waste liquid absorbing material for absorbing the liquid flowed into the waste liquid receptacle are provided (see, for example, Patent Documents 1 and 2).

Japanese Laid-open Patent Publication No. 2011-167960 (Patent Document 1) and Japanese Laid-open Patent Publication No. 2012-86551 (Patent Document 2) are examples of the related art.

SUMMARY

Problems to be Solved by the Invention

However, the density of the waste liquid absorbing material mounted in the aforementioned device is approximately uniform, and therefore there are problems that, in cases where the permeability of the waste liquid with respect to the waste liquid absorbing material is relatively good, the retention performance for retaining the absorbed waste liquid deteriorates, while in cases where the retention performance of the absorbed waste liquid with respect to the waste liquid absorbing material is relatively good, the permeability for absorbing the waste liquid deteriorates.

Means Used to Solve the Above-Mentioned Problems

The invention was made to solve at least a part of the aforementioned problems, and is capable of realizing the following examples or applied examples.

Application Example 1

A waste ink absorber according to this applied example is a waste ink absorber to absorb waste ink discharged from a head for ejecting ink, and it is provided with the first portion and the second portion having different densities in a thickness direction of a single piece of the waste ink absorber. The first portion has higher density than the second portion.

According to this applied example, the waste ink absorber is provided with a portion (second portion) where the density is low in the thickness direction, and a portion (first portion) where the density is high. These portions where the densities are different are configured in a uniformed fashion (single piece). Further, in the portion where the density is low, the permeability to absorb the waste ink can be enhanced, and also, in the portion where the density is high, the retention to retain the absorbed waste ink can be enhanced. Accordingly, the waste ink absorber having excellent permeability and excellent retention can be provided. Here, in the case that the absorber that the density is high and the absorber that the density is low are laid, if the entire contact surfaces are not tightly bonded, there can be a case that the permeability is inhibited. On the other hand, in this applied example, it is in a uniform fashion so that the permeability is excellent. By the way, the waste ink denotes, for example, ink which was discharged from a head but not reached a medium. Specifically, the waste ink denotes ink generated by flushing for ejecting ink for the purpose of preventing increasing of ink viscosity, etc., or cleaning for forcibly discharging ink with a pump, etc., for the purpose of recovering of a nozzle which became unable to eject ink by increased ink viscosity or destruction of meniscus, influence of paper powder, etc., or preventing increasing of ink. Further, in the so-called borderless printing, since ink deviated from a medium is also ink which has not reached the medium, it is included in waste ink.

Application Example 2

In the waste ink absorber according to the above applicable example, the waste ink is absorbed from the second portion.

According to this applied example, the waste ink can be easily absorbed.

Application Example 3

The waste ink absorber according to the above applied examples includes a flame retardant, and the density is the density of the flame retardant.

With this structure, the retention of the waste ink can be enhanced in, especially, the portion where the density is high by the hydrophilic property that is included in the flame retardant.

Application Example 4

In the waste ink absorber according to the above applied examples, the first portion is a surface part of both sides in the thickness direction, and the second portion is a central part in the thickness direction.

With this structure, the surface part of both sides in the thickness direction of the ink absorber is a portion where the density is high, and the central part is a portion where the density is low. And, the portion where the density is low can enhance the permeability to absorb the waste ink, and also, the portion where the density is high can enhance the retention to retain the absorbed waste ink. Therefore, the waste ink absorber that has excellent permeability and excellent retention can be provided.

Application Example 5

In the waste ink absorber according to the above applied examples, the waste ink is absorbed from the central part in the state that the thickness direction is arranged horizontally.

With this structure, when the thickness direction is set in the horizontal state, the high density portion and the low density portion are arranged in a vertical direction. Because of this, the low density portion of the central part is presented on the surface so that the waste ink is easily absorbed. In addition, the waste ink can be easily absorbed by using gravity.

Applied Example 6

The waste ink tank according to this applied example is provided with the aforementioned waste ink absorber and a container portion for containing the waste ink absorber.

With this structure, by containing the waste ink absorber having waste ink permeability and retention property, for example, even in cases where the waste ink tank is arranged obliquely or sideways, the absorbed waste ink can be retained to prevent leakage, etc.

Applied Example 7

In the waste ink tank according to this applied example, the container portion has a bottom surface portion that supports the waste ink absorber, and the waste ink absorber has a recess portion provided from the first portion to the second portion, and the second portion is arranged to oppose to the bottom surface portion of the container portion.

With this structure, the low density portion of the waste ink absorber is arranged to correspond to the bottom surface portion of the container portion. Because of this, the high density portion of the waste ink absorber is presented on the surface. In addition, the recess portion is formed from the high density portion to the low density portion. Accordingly, for example, by flowing the waste ink to the recess portion, the flowed waste ink reaches to the low density portion so that the waste ink can be efficiently absorbed. In addition, the high density portion is presented on the surface so that for example, even when the waste ink tank is arranged obliquely or sideways, the absorbed waste ink is retained so that it can be prevented from the leakage.

Applied Example 8

The liquid droplet ejecting device according to this applied example is provided with a head that injects ink, and the aforementioned waste ink tank that captures the waste ink discharged from the head.

With this structure, the waste ink discharged from the head is captured by the waste ink absorber contained in the waste ink tank. The ink absorber has the portion where the density is low and the portion where the density is high, so that it has excellent permeability and retention of the waste ink. Accordingly, the waste ink is efficiently absorbed so that as the waste ink tank, the miniaturization can be realized, and as the liquid droplet ejecting device, the miniaturization can be realized. Also, a highly-reliable liquid droplet ejecting device capable of absorbing waste ink efficiently without causing defects such as ink leakage, etc., can be provided.

BRIEF DESCRIPTION OF THE DRAWINGS

Referring now to the attached drawings which form a part of this original disclosure.

DETAILED DESCRIPTION OF EXEMPLARY EMBODIMENTS

First Embodiment

Hereinafter, the first embodiment of the invention will be described in reference to the drawings. In each of the following drawings, the measurement of each member, etc., is shown to be different from the actual measurement in order to attain recognizable size of each member, etc.

Figure 1:
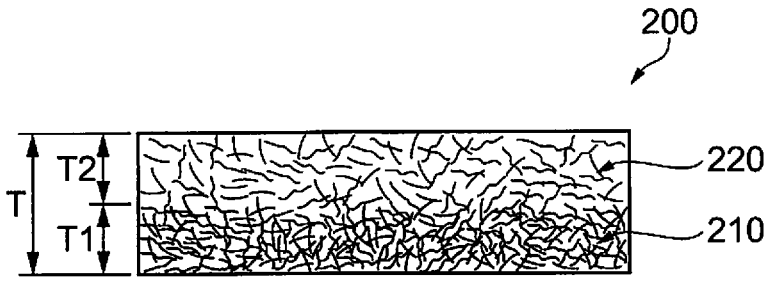
FIG. 1 is a pattern diagram showing a structure of a waste ink absorber.

Initially, the structure of a waste ink absorber will be described. FIG. 1 is a pattern diagram showing a structure of a waste ink absorber, and it is a side view of a rectangular waste ink absorber 200. The waste ink absorber 200 is used to absorb the waste ink discharged from a head for ejecting ink, and as shown in FIG. 1, in a thickness direction of a single piece of the waste ink absorber 200, it has a portion 220 where the density is low and a portion 210 where the density is higher in comparison with the low density portion 220. In the waste ink absorber 200 according to the present embodiment, in the thickness T of the waste ink absorber 200 formed in a single piece (single body), the portion of the thickness T1 is the portion 210 where the density is high, and the portion of the thickness T2 is the portion 220 where the density is low. In other words, the portion 220 where the density is low is formed on one surface side (upper side in the drawing) in the thickness direction of the waste ink absorber 200, and the portion 210 where the density is high is formed on the other surface side opposing to the one surface side. In such waste ink absorber 200, it is preferred to have a structure that the waste ink is absorbed from the low density portion 220. The waste ink can be easily (promptly) absorbed by the structure that the waste ink is absorbed from the portion 220 where the density is low. Also, the portion 210 where the density is high reduces the permeability of the waste ink in comparison with the portion 220 where the density is low, but the portion has a high retention to retain the absorbed waste ink.

The waste ink absorber 200 is constituted by a mixture including cellulose fibers, thermoplastic resin and flame retardant.

The cellulose fibers are obtained by fibrillating a pulp sheet, etc., using, for example, a dry type fibrillation machine such as a rotary crushing apparatus, etc. The thermoplastic resin contributes to bonding of cellulose fibers, retention of appropriate strength (hardness, etc.) of the waste ink absorber 200, prevention of scattering of paper powder/fibers, and maintaining of the shape at the time of absorbing waste ink. The thermoplastic resin allows adaption of any configurations such as a fiber form or a powder form. By heating the mixture in which the cellulose fibers and the thermoplastic resin are mixed, the thermoplastic resin can be thermoplastic, the cellulose fibers are bonded each other. It is preferable that the welding is performed at a temperature not causing thermal deterioration of the cellulose fibers, etc. The thermoplastic resin is preferably a fibrous resin which is easily tangled with paper fibers in the fibrillated fabric. Further, it is preferable to be a composite fiber of a core-in-sheath structure. In the thermoplastic resin of the core-in-sheath structure, the peripheral sheath portion melts at a low temperature, and the fibrous core portion is bonded to the thermoplastic resin itself or the cellulose fiber, resulting in a strong juncture.

The flame retardant is added to give flame retardant properties to the waste ink absorber 200. As the flame retardant, for example, inorganic materials such as aluminum hydroxide, magnesium hydroxide, and the like, or phosphoric organic materials (e.g., aromatic ester phosphate such as triphenylphosphate, and the like) can be used. By the way, in the present embodiment, the density of the waste ink absorber 200 is formed to correspond to at least one of the densities of cellulose fibers, thermoplastic resin, and flame retardant.

As a method of forming the waste ink absorber 200, for example, a mixture in which cellulose fibers, thermoplastic resin and flame retardant are mixed is screened to accumulate on a mesh belt arranged below the screen so as to form a deposited material. In this point, it is deposited to form a portion where the density is low and a portion where the density is high in the mixture in the thickness direction. Then, the formed deposited material is subjected to a pressurization and heating treatment. With this, the thermoplastic resin is fused to obtain a desired thickness. By subjecting it to die cutting into a desired size, a waste ink absorber 200 is formed.

Figure 2A:
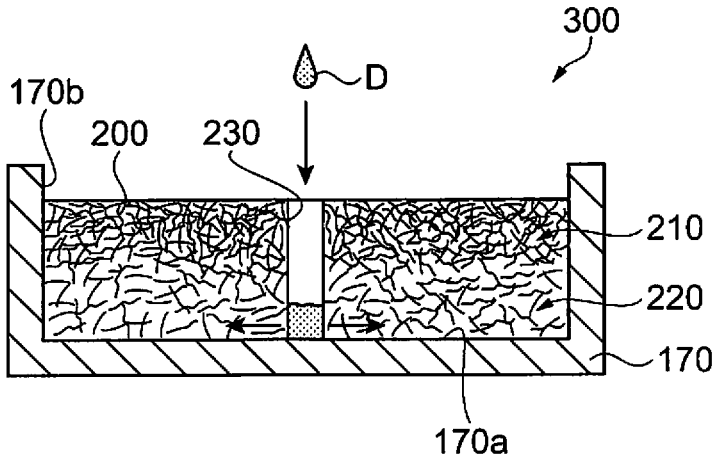
FIGS. 2A and 2B are schematic views showing a structure of a waste ink tank.
Figure 2B:
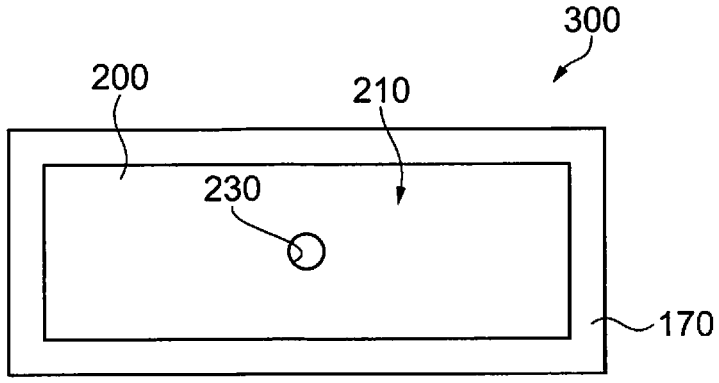

Next, a structure of a waste ink tank will be described. FIGS. 2A and 2B show the structure of the waste ink tank. FIG. 2A is a cross-sectional view and FIG. 2B is a plan view. As shown in FIGS. 2A and 2B, a waste ink tank 300 is provided with a waste ink absorber that has a portion where the density is low and a portion where the density is high in the thickness direction of a single piece of the waste ink absorber, and an container portion for containing the waste ink absorber. The container portion has a bottom surface portion that supports the waste ink absorber. The waste ink absorber has a recess portion that is provided from the portion where the density is high to the portion where the density is low. The low density portion is placed to be opposed to the bottom surface portion of the container portion. The detailed description will be discussed below.

The structure of the waste ink absorber 200 is the same as the structure shown in FIG. 1, and therefore the explanation will be omitted. By the way, the recess portion is provided from the portion 210 where the density is high to the portion 220 where the density is low in the waste ink absorber 200. In the present embodiment, a through hole 230 that impregnates through in the thickness direction of the waste ink absorber 200 is provided as the recess portion. By the way, a position of the through hole 230 can be appropriately set, and for example, it can be set to correspond to a position where the waste ink is discharged. Also, the number of through holes 230 can be appropriately set.

The container portion 170 for containing the waste ink absorber 200 is rectangularly formed by, for example, a plastic material. The container portion 170 is provided with a bottom surface portion 170*a* and a side surface view 170*b* so as to be able to contain and retain the waste ink absorber 200.

Next, an arrangement method of the waste ink absorber 200 with respect to the container portion 170 will be described. As shown in FIG. 2A, the low density portion 220 of the waste ink absorber 200 is arranged to be opposed to the bottom surface portion 170*a* of the container portion 170. Accordingly, in the present embodiment, as shown in FIG. 2B, the waste ink absorber 200 has a structure that the low density portion 220 is arranged in a back surface direction so that it is hidden in the plan view, and the high density portion 210 is presented in the surface.

By having such a structure, the exposed surface in the waste ink absorber 200 arranged in the container portion 170 contains a lot of flame retardant. On the other hand, the portion where a lot of flame retardant are not contained is covered by the container portion 170. Because of this, even if there is a member that becomes high temperature in the vicinity of the waste ink tank, the waste ink tank does not burn. However, the density of the exposed surface of the waste ink absorber 200 is high so that when the waste ink droplet D is discharged in this surface, it is difficult to absorb. Thus, as shown in FIG. 2A, when the waste ink droplet D is discharged toward the through hole 230, the waste ink reaches to the bottom surface portion 170*a* of the container portion 170, and it is absorbed from the low density portion 220 in the surroundings of the bottom surface portion 170*a* and is impregnated in the waste ink absorber 200. And, there is a structure that the waste ink impregnated to the upper part is retained by the high density portion 210.

Figure 3A:
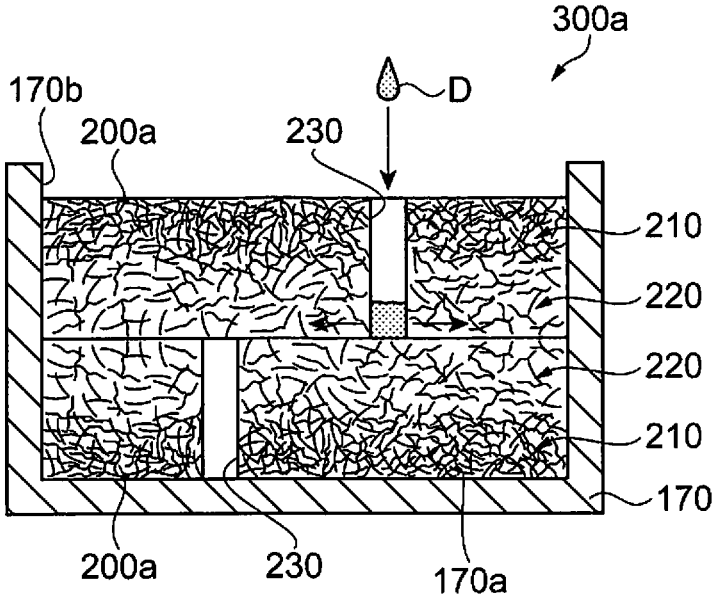
FIGS. 3A and 3B are schematic views showing a structure of another waste ink tank.
Figure 3B:
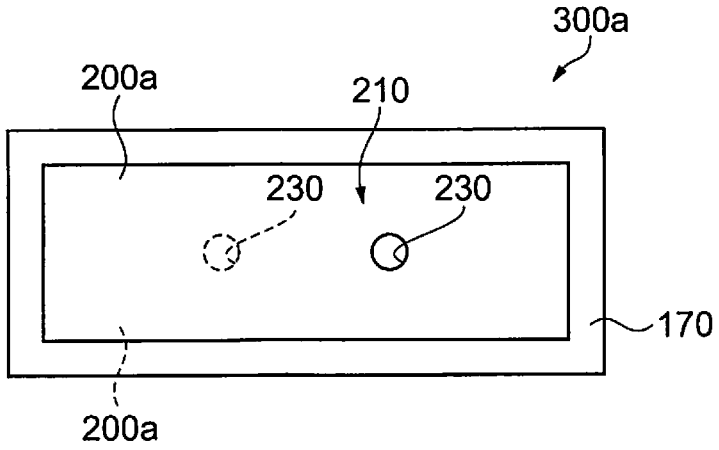

By the way, the above waste ink tank 300 had a structure to use one waste ink absorber 200, but it is not limited to this structure. FIGS. 3A and 3B are schematic views showing a structure of another waste ink tank. FIG. 3A is a cross-sectional view and FIG. 3B is a plan view. As shown in FIGS. 3A and 3B, the waste ink tank 300*a* has a structure that contains a plural number of waste ink absorbers 200*a*. FIGS. 3A and 3B show a structure in the case of containing two waste ink absorbers 200*a*.

The basic structure of the waste ink absorber 200 is the same structure as described in FIG. 1, and the explanation is omitted. By the way, the through hole 230 that impregnates through in the thickness direction is provided in the waste ink absorber 200*a*. A position of the through hole 230 can be appropriately set, and for example, it can be set to correspond to a position where the waste ink is discharged. Also, the structure of the container portion 170 is the same structure as described in FIGS. 2A and 2B, and therefore the explanation is omitted.

As shown in FIG. 3A, among the two waste ink absorbers 200*a*, the high density portion 210 of one of the waste ink absorber 200*a* is arranged to be opposed to the bottom surface portion 170*a* of the container portion 170. And, the low density portion 220 of the other one of the waste ink absorber 200*a* is arranged to be opposed to the low density portion 220 of the one arranged waste ink absorber 200*a*. Further, as shown in FIG. 3B, it has a structure that the high density portion 210 is presented in the surface. Also, in the plan view, the through holes 230 formed in the respective two waste ink absorbers 200*a* are configured to arrange in a different position.

By having such a structure, as shown in FIG. 3A, when the waste ink droplet D is discharged toward the through hole 230 of the waste ink absorber 200*a* arranged in the upper side, the waste ink reaches to the low density portion 220 of the waste ink absorber 200*a* arranged in the lower side so that it is absorbed from the low density portions 220 in upper and lower sides. In this time, the waste ink is absorbed in the respective waste ink absorbers 200*a* in the upper side and the lower side. It is easy to get impregnated in comparison with the case that it is absorbed to one waste ink absorber and impregnated to the different absorber that is laid. And, the absorbed waste ink is retained by the high density portion 210 that is arranged to be opposed to the bottom surface portion 170*a* and the high density portion 210 in the surface direction.

By the way, in the above structure, two waste ink absorbers 200*a* are the same shape. The through holes 230 are formed by deviating from a center, and one of the two waste ink absorbers is arranged by rotating 180 degrees with respect to the center as a fulcrum. Accordingly, it is not required to manufacture the waste ink absorbers 200*a* corresponding to the lamination order of the waste ink absorbers 200*a* so that the waste ink tank 300*a* can be efficiently provided. By the way, it is not required to rotate 180 degrees, and the position of the through hole 230 can be deviated by turning over. Here, when the through holes 230 of the two waste ink absorbers 200*a* are laid in the same position, the discharged waste ink droplet D reaches to the bottom surface portion 170*a*, and it is absorbed from the portion 210 where the density is high. In this case, the density is high and it has to be impregnated for the thicknesses of two absorbers and against gravity. Therefore, the malfunction occurs such that it cannot be impregnated to the entire absorbers.

Second Embodiment

The second embodiment of the invention will be described with reference to the drawings below. By the way, in each of the following drawings, the measurement of each member, etc., is shown to be different from the actual measurement in order to attain recognizable size of each member, etc.

Figure 4A:
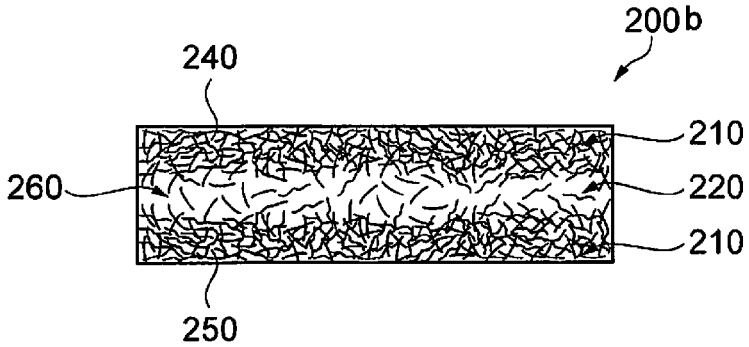
FIGS. 4A and 4B are pattern diagrams showing a structure of a waste ink absorber.
Figure 4B:
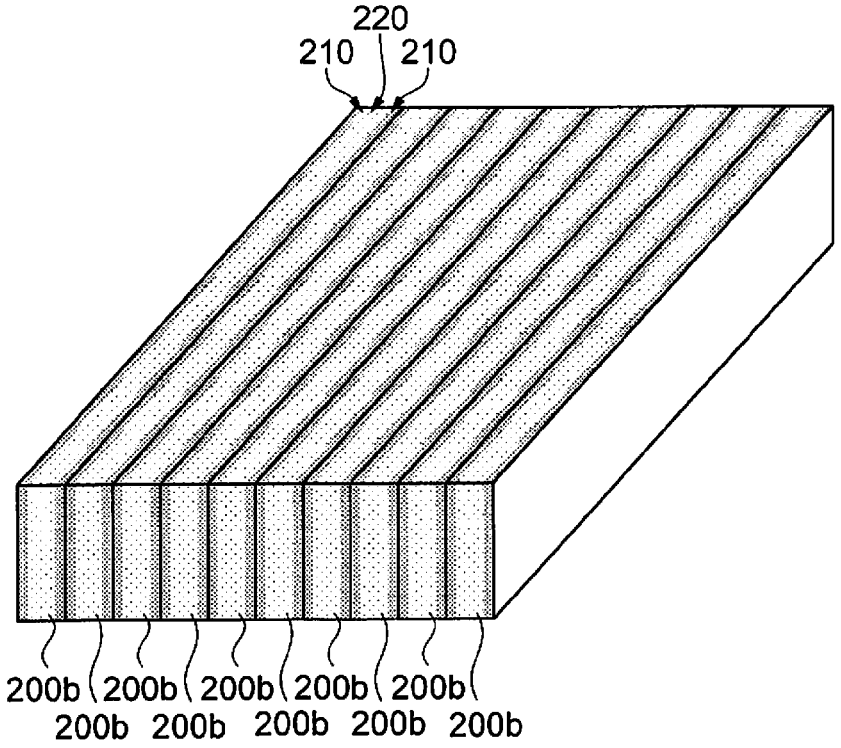

Initially, the structure of the waste ink absorber will be described. FIGS. 4A and 4B are pattern diagrams showing a structure of a waste ink absorber, and FIG. 4A is a cross-sectional view showing a structure of a rectangular waste ink absorber 200*b*. The waste ink absorber 200*b* is to absorb the waste ink discharged from a head that injects inks, and as shown in FIG. 4A, in a single piece of the waste ink absorber 200*b*, the density of both sides of surface parts 240, 250 in the thickness direction is higher than the density of a central part 260. The density is gradually reduced from the both sides of surface parts 240, 250 to the central part 260.

The portion 220 of the waste ink absorber 200*b* where the density is low is a portion that the waste ink is easily impregnated, and the high density portion 210 is a portion where the waste ink is retained. Accordingly, when the waste ink is absorbed, it is preferred to absorb it from the low density portion 220 formed in the central part 260. In addition, it is more preferred to absorb the waste ink from the central part 260 in the condition that the thickness direction is in a horizontal state. Accordingly, the waste ink can be easily impregnated by using gravity.

The waste ink absorber 200*b* is constituted by a mixture including cellulose fibers, thermoplastic resin and flame retardant.

The cellulose fibers are obtained by fibrillating a pulp sheet, etc., using, for example, a dry type fibrillation machine such as a rotary crushing apparatus, etc. The thermoplastic resin contributes to bonding of the cellulose fibers, retention of an appropriate strength (hardness, etc.) of the waste ink absorber 200*b*, prevention of scattering of paper powder/fibers, and maintaining of the shape at the time of absorbing waste ink. The thermoplastic resin allows adaption of any configurations such as a fiber form or a powder form. By heating the mixture in which the cellulose fibers and the thermoplastic resin are mixed, the thermoplastic resin can be thermoplastic, welded to the cellulose fibers and solidified. It is preferable that the welding is performed at a temperature not causing thermal deterioration of the cellulose fibers, etc. The thermoplastic resin is preferably a fibrous resin which is easily tangled with paper fibers in the fibrillated fabric. Further, it is preferable to be a composite fiber of a core-clad structure. In the thermoplastic resin of the core-in-sheath structure, the peripheral sheath portion melts at a low temperature, and the fibrous core portion is bonded to the thermoplastic resin itself or the cellulose fiber, resulting in a strong juncture.

The flame retardant is added to give flame retardant properties to the waste ink absorber 200*b*. As the flame retardant, for example, inorganic materials such as aluminum hydroxide, magnesium hydroxide, and the like, or phosphoric organic materials (e.g., aromatic ester phosphate such as triphenylphosphate, and the like) can be used.

As a formation method of the waste ink absorber 200*b*, for example, the mixture in which cellulose fibers, thermoplastic resin, and flame retardant were mixed is screened, and a deposited member is formed by depositing it on a mesh belt placed under the screen. And, the formed deposited member is subjected to a pressurization and heating treatment. By the way, in the present embodiment, a heating plate press is used. Specifically, the both sides of the surface parts are pressed in the thickness direction of the deposits. Therefore, the thermoplastic resin is melted and the desired thickness is formed. Also, by using the heating plate press, the heat is transmitted to the portion corresponding to the surface parts 240, 250 earlier than the portion corresponding to the central part 260, and the softening begins and it is deformed by the press so that the density of the surface parts 240, 250 is higher than the central part 260. After that, the waste ink absorber 200*b* is formed by molding in a desired size.

FIG. 4B is a pattern diagram showing a structure that a plural number of waste ink absorbers are laid. As shown in FIG. 4B, a plurality of waste ink absorbers 200*b* is laid. In the present embodiment, the structure in which 10 waste ink absorbers 200*b* are laid is shown. Because of this, the permeability of the waste ink is secured and the absorption tolerance of the waste ink can be increased. By the way, the structure of the respective waste ink absorbers 200*b* has the same structure as FIG. 4A, and the explanation is omitted.

Figure 5:
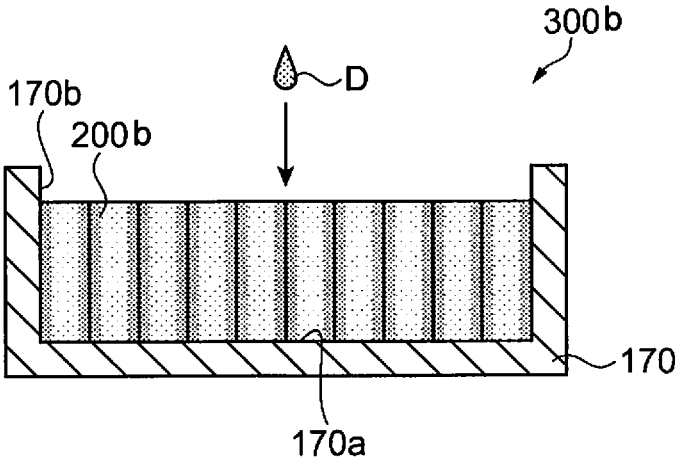
FIG. 5 is a schematic view showing a structure of a waste ink tank.

Next, a structure of a waste ink tank will be described. FIG. 5 is a cross-sectional view showing the structure of the waste ink tank. As shown in FIG. 5, the waste ink tank 300*b* is provided with the waste ink absorbers 200*b* that absorb the waste ink and an container portion 170 that contains the waste ink absorbers 200*b*.

The container portion 170 for containing the waste ink absorbers 200*b* is rectangularly formed by, for example, a plastic material. The container portion 170 includes a bottom surface portion 170*a* and a side surface portion 170*b*, and is formed to be able to contain and retain the waste ink absorbers 200*b*.

The structure of the waste ink absorbers 200*b* has the same structure as described FIG. 4A, and the explanation is omitted. By the way, a plurality of waste ink absorbers 200*b* are laid and mounted. In addition, the respective waste ink absorbers 200*b* in the thickness direction are mounted in a horizontal state. Accordingly, the high density portion 210 and the low density portion 220 are presented on the surface opposing to the waste ink droplet D.

As shown in FIG. 5, the waste ink droplet D is discharged toward the waste ink absorbers 200*b*, and when it reaches to the surface of the waste ink absorbers 200*b*, the waste ink droplet D is efficiently absorbed from the low density portion 220 that is presented on the surface of the waste ink absorbers 200*b*. And, the absorbed waste ink is retained by the high density portion 210.

Next, a structure of a liquid droplet ejecting device will be described. The liquid droplet ejecting device is provided with a head that injects inks and a waste ink tank that captures the waste ink discharged from the head. By the way, in the liquid droplet ejecting device of the present embodiment, it will be described in the structure that the above waste ink absorber 200 (200*a*, 200*b*) and the waste ink tank 300 (300*a*, 300*b*) are provided.

Figure 6:
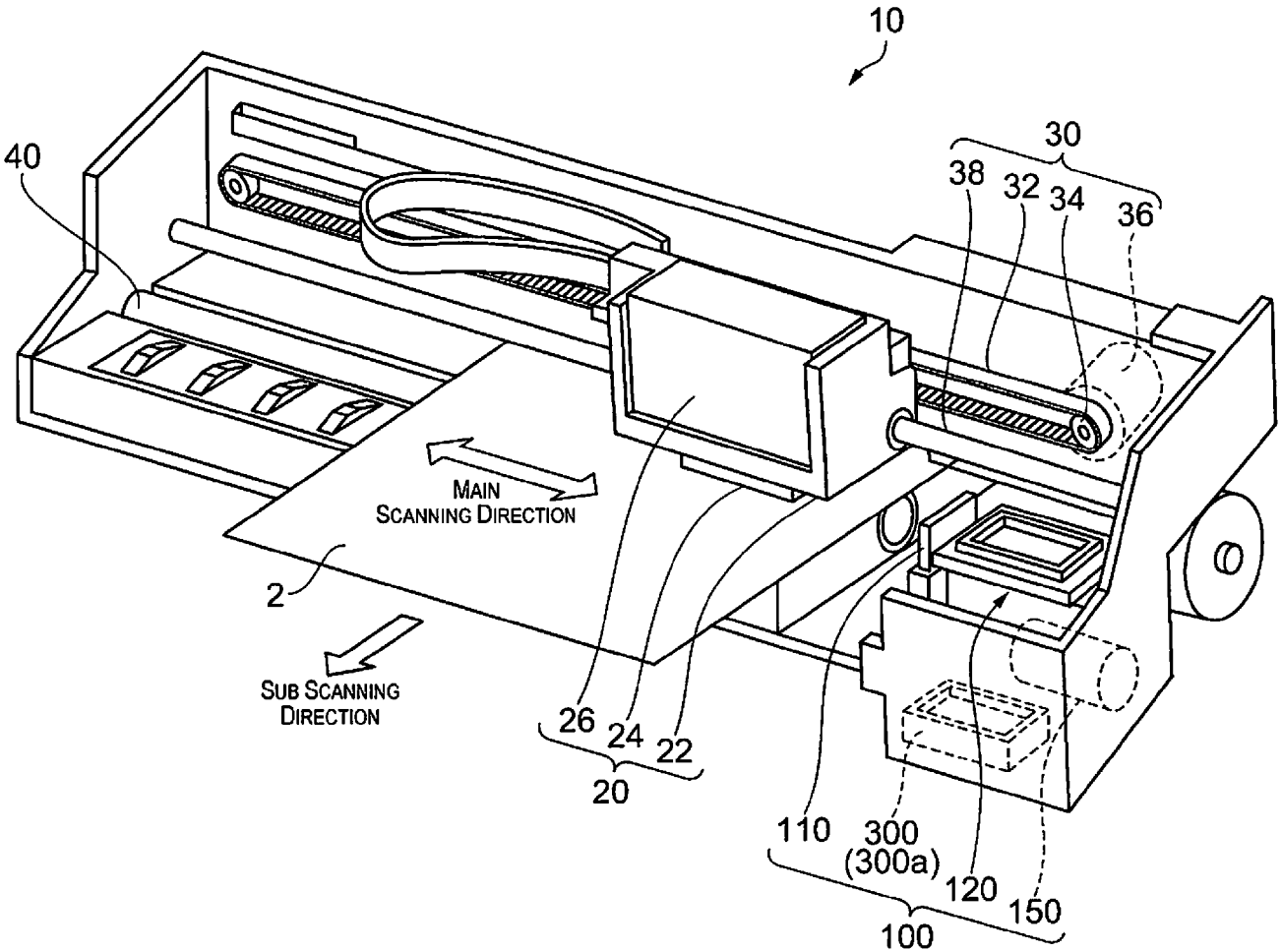
FIG. 6 is a schematic view showing a structure of a liquid droplet ejecting device.

FIG. 6 is a schematic view showing a structure of a liquid droplet ejecting device. As shown in FIG. 6, the liquid droplet ejecting device 10 is constituted by, e.g., a carriage 20 for forming ink dots on a printing medium 2 such as a printing paper while reciprocating in the main scanning direction, a drive mechanism 30 for reciprocating the carriage 20, a platen roller 40 for feeding the printing medium, a maintenance mechanism 100 for performing maintenance to enable normal printing, etc. The carriage 20 is provided with an ink cartridge 26 accommodating ink, a carriage case 22 for attaching the ink cartridge 26, a head 24 for ejecting ink mounted on the bottom surface side (the side facing the printing medium 2) of the carriage case 22, etc. In the head 24, a plurality of nozzles for ejecting ink is formed. The ink in the ink cartridge 26 is introduced to the head 24, and injected onto the printing medium 2 by the exact amount to thereby print an image.

The drive mechanism 30 for reciprocating the carriage 20 is constituted by the guide rail 38 extending in the main scanning direction, a timing belt 32 having a plurality of teeth on the inside, a driving pulley 34 engaged with the teeth of the timing belt 32, a step motor 36 for driving the driving pulley 34, etc. A part of the timing belt 32 is fixed to the carriage case 22, and by driving the timing belt 32, the carriage case 22 can be moved along the guide rail 38. Further, since the timing belt 32 and the driving pulley 34 are engaged with each other by the teeth, when the driving pulley 34 is driven by the step motor 36, it is possible to move the carriage case 22 depending on the driven amount with high accuracy.

The platen roller 40 for feeding the printing medium 2 is driven by non-illustrated driving motor and gear mechanism, so that the printing medium 2 can be fed by a certain amount in a sub scanning direction.

The maintenance mechanism 100 is arranged in a region called a home position located outside the printing region, and is provided with a wiper blade 110 for sweeping the surface (nozzle surface) to which an injection nozzle is formed on the bottom surface side of the head 24, a cap unit 120 for capping the head 24 by being pressed against the nozzle surface of the head 24, and a suction pump 150 for discharging ink as waste ink by being driven in a state in which the head 24 is capped with the cap unit 120. The suction pump forcibly discharges ink from the head 24 to thereby recover the nozzle which became unable to eject ink due to increased ink viscosity, destruction of meniscus, influence of paper powder, etc., or prevent the ink in the nozzle from being increased in ink viscosity. Further, below the suction pump 150, a waste ink tank 300 (300*a*, 300*b*) for capturing the waste ink discharged from the suction pump 150 is provided. By providing the waste ink tank 300, the outer shape of the liquid droplet ejecting device 10 increases. By improving the ink permeability and retaining properties of the waste ink absorber 200, the volume of the waste ink absorber 200 capable of retaining the same amount of ink can be reduced. With this, the size of the waste ink tank 300 and liquid droplet ejecting device 10 is reduced. The waste ink tank 300 (300*a*, 300*b*) has the same structure as the structure explained with reference to FIGS. 2A-2B and 3A-3B, and therefore the explanation will be omitted. The discharged ink also includes ink by flushing that flushes ink for the purpose of ink viscosity increase prevention, and ink failed to reach a medium such as the ink injected outside a medium in the so-called borderless printing. Therefore, the waste ink is not limited to the ink discharged by the suction pump 150. The waste ink denotes ink which was discharged from the head but not reached a medium.

According to the aforementioned present embodiments, the following effects can be obtained.

(1) The portion 220 where the density is low and the portion 210 where the density is high are provided in the thickness direction of the waste ink absorber 200, and these portions where the densities are different are configured as a single body (a single piece). And, in the portion 220 where the density is low, the permeability that impregnates the waste ink can be enhanced, and also, in the portion 210 where the density is high, the retention performance for retaining the impregnated waste ink can be enhanced. Accordingly, the waste ink absorber 200 (200*a*, 200*b*) having permeability and retention can be provided.

(2) In the waste ink tanks 300, 300*a*, 300*b* in which the above waste ink absorber 200 is provided, even when the waste ink tanks 300, 300*a*, 300*b* are arranged obliquely or sideways, the absorbed waste ink is retained so that it can be prevented from leakage, and the like.

(3) In the liquid droplet ejecting device 10 provided with the aforementioned waste ink tanks 300, 300*a*, 300*b*, the waste ink discharged from the head 24 is efficiently absorbed without causing defects such as ink leakage, etc. so that the reliability can be secured.

EXAMPLES

Next, the specific examples according to the invention will be described.

1. Mixture (1) Cellulose Fibers

A pulp sheet cut into a few centimeters using a cutting machine was fibrillated into a cotton-like manner with a turbo mill (made by Turbo Kogyo Co., Ltd.).

(2) Thermoplastic Resin

The thermoplastic resin had a core-in-sheath structure. The sheath was polyethylene melting at 100° C. or above, and the core was a thermoplastic fiber of 1.7 dtex (Tetoron, Teijin Ltd.) made of polyester.

(3) Flame Retardant

Aluminum hydroxide B53 (made by Nippon Light Metal Co., Ltd.).

2. Formation of Waste Ink Absorber

Example 1

Formation of Waste Ink Absorber A

A mixture C1 in which 100 weight parts of cellulose fibers, 15 weight parts of thermoplastic fiber, and 5 weight parts of flame retardant were mixed in air. The mixture C1 was screened to cause accumulation on the mesh belt. At this time, the suctioning of the suction device was controlled to collect the flame retardant which is smaller than the cellulose fibers or the thermoplastic resin, or the cellulose fibers which are a short length among the cellulose fibers, and they were deposited on the mesh belt. And, the deposited material was subjected to the pressurization and heating treatment. After that, the waste ink absorber A was formed by cutting into 150 mm×50 mm×12 mm. When the density of the waste ink absorber A was measured, the density was not uniformed in the thickness direction, and the cellulose fibers deposited in the mesh belt side in the lower layer side had more short length cellulose fibers then the upper layer side so that the density became high. Also, the distribution of the flame retardant was not uniformed in the thickness direction of the waste ink absorber A, and the content ratio in the lower layer side was higher than the upper layer side. That is, the density of the flame retardant in the lower layer side was higher than the upper layer side. As an absorber, the highest density portion was 0.16 g/cm$^3$, and the lowest density portion was 0.13 g/cm$^3$.

Example 2

Formation of Waste Ink Absorber B

A mixture C2 in which 100 weight parts of cellulose fibers, 25 weight parts of thermoplastic fiber, and 10 weight parts of flame retardant were mixed in air was formed. Also, a mixture C3 in which 100 weight parts of cellulose fiber, 15 weight parts of thermoplastic fiber, and 5 weight parts of flame retardant were mixed in air was formed. And, they were deposited on the mesh belt without using the suction device. First, the mixture C2 went through the screen and was freely fallen on the mesh belt so as to be deposited by self-weight. After that, the mixture C3 went through the screen and was freely fallen on the deposited mixture C2 so that the mixture C3 was deposited by self-weight on the mixture C2. And, the deposit material was subjected to the pressurization and heating treatment. After that, the waste ink absorber B was formed by cutting into 150 mm×50 mm×12 mm. When the density of the waste ink absorber B was measured, the density was not uniformed in the thickness direction, and the mesh belt side in the lower layer side had higher density than the upper layer side. Also, the distribution of the flame retardant was not uniformed in the thickness direction of the waste ink absorber B, and the content ratio in the lower layer side was higher than the upper layer side. That is, the density of the flame retardant in the lower layer side was higher than the upper layer side. As an absorber, the highest density portion was 0.17 g/cm$^3$, and the smallest density portion was 0.14 g/cm$^3$.

Example 3

Formation of Waste Ink Absorber C

A mixture C4 in which 100 weight parts of cellulose fibers, 15 weight parts of thermoplastic fiber, and 10 weight parts of flame retardant were mixed in air went through the screen and was deposited on the mesh belt. And, the deposit material was subjected to the pressurization and heating treatment. Here, in the pressurization and heating treatment, it was pressed from the both upper side and lower side of the deposit material by the heating plate press. By the way, any of a hydraulic press, an air press, a mechanical press, and the like can be used as a press mechanism. For example, the heating plate is 20 mm of aluminum plate, and it is heated at a desired temperature by a mica heater on its back surface. A Teflon (registered trademark) sheet was wrapped around on the surface of the aluminum plate so that it is prevented from sticking the thermoplasticfibers. For the heating plate, other metal plate such as copper, and the like can be used. Also, for the heater, any heating member such as oil heater, sheath heater, and the like can be used. A spacer was provided in the back and forth of the deposits that was fed to the plate press, and the thickness was defined when it was pressed. And, the deposits was pressed to, for example, a thickness of one in ten (1/10) to one half (1/2) with respect to the original thickness by the heating plate press. In the present example, it was heated in the heating plate temperature 200° C. for 90 seconds. After that, the waste ink absorber C was formed by cutting in 150 mm×50 mm×10 mm. By the way, the heat diffusivity a of the formed waste ink absorber C was 0.3287 mm$^2$/s.

Figure 7:
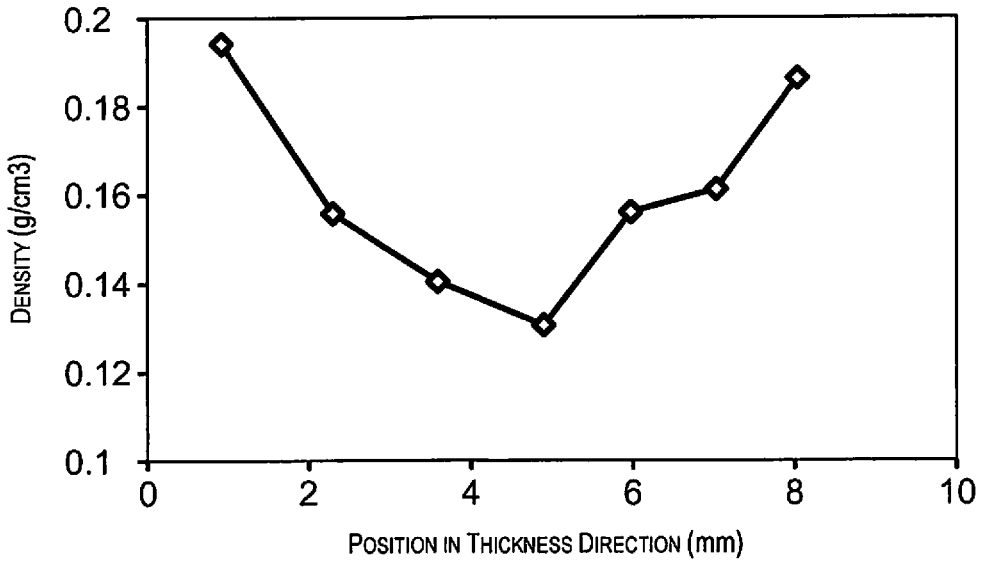
FIG. 7 is a diagram showing a density distribution in a thickness direction of the waste ink absorber.

FIG. 7 is a diagram showing a density distribution in a thickness direction of the waste ink absorber. As shown in FIG. 7, the density in the thickness direction of the waste ink absorber A is not uniformed, and the density of the surface part of the waste ink absorber A is higher than the density of the central part.

Comparative Example 1

Formation of Waste Ink Absorber R

A mixture C5 in which 100 weight parts of cellulose fibers, 15 weight parts of thermoplastic fiber, and 5 weight parts of flame retardant were mixed in air went through the screen so as to be deposited on the mesh belt. In this time, it was freely deposited without using the suction device. And, the deposit material was subjected to the pressurization and heating treatment. After that, the waste ink absorber R was formed by cutting in 150 mm×50 mm×10 mm. When the density of the waste ink absorber R was measured, the density was uniformed in 0.14 g/cm$^3$ in the thickness direction. Also, the content ratio of the flame retardant was uniformed.

Comparative Example 2

Formation of Waste Ink Absorber S

A mixture C6 in which 100 weight parts of cellulose fibers, 15 weight parts of thermoplastic fiber, and 10 weight parts of flame retardant were mixed in air went through the screen so as to be deposited on the mesh belt. And, the deposit material was subjected to the pressurization and heating treatment. Here, in the pressurization and heating treatment, the aforementioned deposit material was fed in a heating oven and after heating, a roll press process was performed. After that, the waste ink absorber S was formed by cutting in 150 mm×50 mm×10 mm. When the density of the waste ink absorber S was measured, the density was uniformed in 0.15 g/cm$^3$ in the thickness direction.

3. Evaluation

Next, in the aforementioned Example 1, Example 2, Example 3, Comparative Example 1 and Comparative Example 2, the ink retention and the deposit performance are evaluated. The respective evaluation methods are described as follows.

(a) Evaluation Methods for Ink Permeability and Ink Retention

Figure 8A:
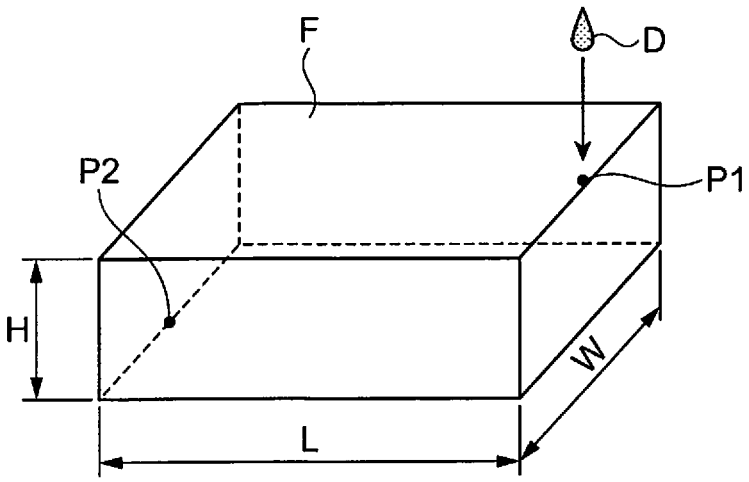
FIGS. 8A and 8B are schematic views showing an evaluation method of ink permeability and retention of the waste ink absorber.
Figure 8B:
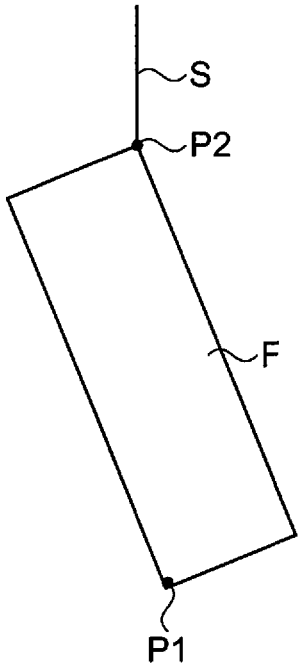

FIGS. 8A and 8B are schematic views showing an evaluation method of ink permeability and retention of the waste ink absorber. As shown in FIG. 8A, the 150 mm (L)×50 mm (W)×12 mm (H) ink absorber F is placed on the flat surface, and the 80 ml ink is slowly poured from the first point P1 of the upper surface. If the ink does not impregnate in the absorber F, it is left for 5 minutes and after that, it continues to be injected. If the ink does not impregnate after it is left for 5 minutes, it is determined that the ink does not impregnate so that the determination of the ink permeability becomes NG. On the other hand, if the ink was able to be injected all, the determination of the ink permeability becomes OK. Here, the ink is absorbed from a different part in FIGS. 2A-2B and FIGS. 3A-3B. When this is used for the liquid droplet ejecting device, there can be a case that the ink is able to be discharged to only the edge part due to the arrangement of other parts so that the evaluation is performed in the worst condition that the ink is hard to impregnate most. Also, if the ink was able to be injected all, it was left for 5 minutes, and as shown in FIG. 8B, it was hanged from the second point P2 by using strap S, and the like so that the first point P1 where the ink was injected was positioned in the lower side. And, when the ink was dripped off from the ink absorber F, it was determined that the ink was not able to be retained so that the determination of the ink retention became NG. On the other hand, when the ink was not dripped off, the determination of the ink retention became OK. According to the evaluations, it was understood that the ink did not leak even when the liquid droplet ejecting device or the waste ink tank was arranged obliquely.

(b) Evaluation Method for Ink Deposition Property

An ink absorber F of 150 mm (L)×50 mm (W)×12 mm (H) is placed on a flat surface, and under the circumstance of 20% RH at 40° C., ink is dropped by 0.4 g at a time every hour on a central portion on the upper surface of the placed absorber F. After passing 240 hours, if the thickness of the solid deposited material on the surface of the ink absorber F is less than 1 mm, the judgment of the ink deposition property is OK. On the other hand, if the thickness of the deposited material is 1 mm or more, the judgment of the ink deposition property is NG.

In the aforementioned examples and comparative examples, the ink permeability, the ink retention and the ink deposition property were evaluated. The evaluation results are shown in Table 1.

TABLE 1

| | Ink Permeability | Ink Retaining property | Ink deposition property |
|---|---|---|---|
| Example 1 | OK | OK | OK |
| Example 2 | OK | OK | OK |
| Example 3 | OK | OK | OK |
| Comparative Example 1 | OK | NG | OK |
| Comparative Example 2 | OK | NG | OK |

As shown in Table 1, in the waste ink absorbers (Examples 1, 2, 3) according to the invention, all of the evaluations of the ink permeability, the ink retention, and the ink deposition property were excellent. On the other hand, in the Comparative Examples, the satisfying results were not obtained. That is, both of the ink permeability and the ink retention cannot be satisfied in comparative Examples 1 and 2 that the density was uniformed. On the other hand, the low density portion and the high density portion in the thickness direction were provided in Examples 1 and 2 so that both of the ink permeability in the low density portion and the ink retention in the high density portion are satisfied. Also, the ink is absorbed from the low density portion so that the ink is promptly impregnated and the deposits are not remained. By the way, in Comparative Example 2, a press is performed after heating in the heating oven. In this case, since the press is performed after the temperature in the deposits became constant by heating in the heating oven, the density of the formed waste ink absorber is uniformed. On the other hand, in Example 3, since the press is performed at the same time of heating, the heat is transmitted to the both sides in the thickness direction but it takes time to transmit heating to the central part. The press is performed in this state so that the density of the both sides becomes high, and the density of the central part becomes low.

In some cases, the high density portion and the low density portion which are features of this application can be recognized by the appearance by eye. However, in some cases, if the low density portion and the high density portion are slightly different from each other, the difference cannot be recognized by eye. In this case of the detection method, the ink is dropped on the surface and the back surface, and if the permeability is different, it is determined that the densities are different. By the way, in the case that the density is uniformed in the entire waste ink absorber, when the ink is dropped, the ink is uniformly impregnated in the front surface and the back surface.

The aforementioned Examples are employed as the waste ink tank and the waste ink absorber used for the liquid droplet ejecting device. Here, ink includes various kinds of liquid compositions, such as, common aqueous ink, oil ink, pigment ink, dye ink, solvent ink, resin ink, sublimation transfer ink, gel ink, hot melt ink, ultraviolet cure ink, etc. Further, ink can be any materials that a head 24 can inject. For example, it is enough that the material is in a liquid phase state, and ink includes not only liquid crystal, a liquid state material high or low in ink viscosity, sol, gel liquid, fluid material such as inorganic solvent, organic solvent, solution, liquid resin, liquid metal (metal thermoplastic solution), liquid as one condition of a material, but also a material in which functional material particles of solid materials such as pigments or metal particles are dissolved, dispersed or mixed in a solvent, etching liquid, lubricating oil. Further, the liquid droplet ejecting device can be, other than an ink jet printer, a device for ejecting ink including electrode materials or materials such as coloring materials used to produce, for example, a liquid crystal display, an EL (electroluminescence) display, a surface emitting display, or a color filter in a dispersed or dissolved manner, a device for ejecting a bio organic substance for use in a bio chip production, a device for ejecting ink as a sample used as a precision pipette, a printing device or a micro dispenser. Furthermore, a device for ejecting lubricating oil to a precision machine such as a clock, a camera, etc., at a pin point, a device for forming, e.g., a small rounded lens (optical lens) for use as an optical communication element, a device for ejecting ultraviolet curable liquid and hardening it by light or heat, or a device for ejecting etching liquid such as acid, alkali, etc., to etch a substrate, etc., can be employed. The invention can be applied to any one of liquid droplet ejecting device among these devices.

In the aforementioned Examples, in order to prevent fluffing of the waste ink absorber, a thin non-woven fabric can be applied on the surface. Since the applied non-woven fabric is thinner than the waste ink absorber, the influence of the ink permeability or the retention performance is small. In the aforementioned Examples, the waste ink absorber 200 was formed into a rectangular shape, but it is not limited to this. A cutout or a recess can be provided in a part of the rectangular, or it can not be the rectangular and can have an arc part or an inclination part. In the respective drawings of the aforementioned Examples, the thicknesses of the low density portion and the high density portion are drawn to be approximately the same thickness. This can be changed depending on ink. For example, if the viscosity of the ink is large and the ink is hard to be impregnated, it is preferable that the thickness of the non-dense part is larger than the thickness of the high density portion so as to impregnate easily. On the other hand, if the ink viscosity is small and it is easy to be impregnated, it is preferable that the thickness of the low density portion is smaller than the thickness of the high density portion. Also, it can be determined in the state of the low density portion and the high density portion, or the density can be gradually increased from the low density portion to the high density portion. By the way, the densities were described in the respective Examples and Comparative Examples, but they are an example. Also, the densities are the numbers at the largest point and the smallest point. In the aforementioned Examples, in order to recognize the low density portion and the high density portion, the material where the density is high can be colored. Also, a recognizable mark such as characters or marks can be provided on the surface in the high density portion side where the ink is not absorbed. In addition, the color of the non-woven fabric that is applied on the surface can be changed so as to be recognizable.

In the aforementioned Examples, the pulp sheet includes a wood pulp of aconifer, a broad-leaf tree, etc., non-wood plant fibers such as hemp, cotton, kenaf, etc. In the aforementioned Examples, cellulose fibers are mainly used, but it is not limited to cellulose fibers as long as it is a material which can absorb ink and differentiate the density. The fiber can be a fiber made from plastic such as polyurethane or polyethylene terephthalate (PET) or another fiber such as wool. The method of forming the waste ink absorber is not limited to the method recited in the aforementioned Examples. As long as the features of the present application can be exerted, another production method such as a wet type method can be employed.

As shown in FIGS. 2A-2B and FIGS. 3A-3B, the surface having the largest surface area of the waste ink absorber 200 was arranged horizontally in the horizontal direction, but the surface having the largest surface area can be arranged vertically in the vertical direction. In the case of the vertical arrangement, the through hole 230 is not required, and the waste ink is absorbed from the portion where the density of the upper surface is low.

What is claimed is:

1. A waste ink absorber adapted to absorb waste ink discharged from a head configured to eject ink in an accommodated state when the waste ink absorber is accommodated in an accommodation portion, the waste ink absorber comprising:

a first portion and a second portion having different densities in a thickness direction of a single piece of the waste ink absorber in an uncompressed state when the waste ink absorber is not accommodated in the accommodation portion, the first portion having higher density than the second portion, each of the first portion and the second portion including a fiber and solid flame retardant powders, the fiber of the first portion being formed of material that is the same as material of which the fiber of the second portion is formed.

2. The waste ink absorber according to claim 1, wherein the waste ink is absorbed from the second portion.

3. The waste ink absorber according to claim 1, further comprising a through hole portion extending through the first portion and the second portion in the thickness direction from a first surface of the waste ink absorber to a second surface of the waste ink absorber, which is opposite the first surface in the thickness direction.

4. The waste ink absorber according to claim 1, wherein the first portion has a density of the solid flame retardant powders that is higher than a density of the solid flame retardant powders that the second portion has.

5. The waste ink tank according to claim 4, wherein each of the solid flame retardant powders is smaller than the fiber.

6. The waste ink absorber according to claim 4, wherein the first portion has a first number of weight parts of the solid flame retardant powders relative to a predetermined weight parts of the fiber, which is greater than a second of weight parts of the solid flame retardant powders relative to the predetermined weight parts of the fiber that the second portion has.

7. The waste ink absorber according to claim 1, wherein the first portion is both sides of surface parts in the thickness direction, and the second portion is a central part in the thickness direction.

8. The waste ink absorber according to claim 7, wherein the waste ink is absorbed from the central part in the state that the thickness direction is arranged horizontally.

9. A waste ink tank comprising:

the waste ink absorber according to claim 1; and an accommodation portion for accommodating the waste ink absorber.

10. The waste ink tank according to claim 9, wherein the accommodation portion has a bottom surface portion that supports the waste ink absorber, and wherein the waste ink absorber has a recess part penetrating in the thickness direction from the first portion to the second portion, and the second portion is arranged to be opposed to the bottom surface portion of the accommodation portion.

11. The waste ink tank according to claim 9, wherein the accommodation portion has a bottom surface portion that supports the waste ink absorber, and the first portion is disposed apart from the bottom surface portion of the accommodation portion such that the second portion is disposed between the first portion and the bottom surface portion in the thickness direction.

12. A liquid droplet ejecting device comprising:

the waste ink tank according to claim 9 for capturing waste ink discharged from the head.

* * * * *